US010746120B2

(12) United States Patent
Dian et al.

(10) Patent No.: US 10,746,120 B2
(45) Date of Patent: Aug. 18, 2020

(54) DIESEL COMMON-RAIL PIEZO-OPERATED SERVO INJECTOR

(71) Applicant: Continental Automotive GmbH, Hannover (DE)

(72) Inventors: Vincent Dian, Manching (DE); Matthias Scheid, Regensburg (DE)

(73) Assignee: CONTINENTAL AUTOMOTIVE GMBH, Hannover (DE)

( * ) Notice: Subject to any disclaimer, the term of this patent is extended or adjusted under 35 U.S.C. 154(b) by 5 days.

(21) Appl. No.: 16/094,273

(22) PCT Filed: Mar. 9, 2017

(86) PCT No.: PCT/EP2017/055603
§ 371 (c)(1),
(2) Date: Oct. 17, 2018

(87) PCT Pub. No.: WO2017/182195
PCT Pub. Date: Oct. 26, 2017

(65) Prior Publication Data

US 2019/0128201 A1 May 2, 2019

(30) Foreign Application Priority Data

Apr. 18, 2016 (DE) ..... 10 2016 206 476

(51) Int. Cl.
*F02D 41/20* (2006.01)
*F02D 41/24* (2006.01)
(Continued)

(52) U.S. Cl.
CPC ..... *F02D 41/2096* (2013.01); *F02D 41/2467* (2013.01); *F02D 41/3827* (2013.01);
(Continued)

(58) Field of Classification Search
CPC ..... F02D 41/2096; F02D 41/3827; F02D 41/2467; F02D 2041/389;
(Continued)

(56) References Cited

U.S. PATENT DOCUMENTS 4,417,201 A * 11/1983 Reddy ..... F02D 41/20 123/490
6,509,672 B2 1/2003 Rueger et al. ..... 310/316.03
(Continued)

FOREIGN PATENT DOCUMENTS

CN 101397962 A 4/2009 ..... F02D 41/20
CN 101663478 A 3/2010 ..... F02D 41/20
(Continued)

OTHER PUBLICATIONS

Korean Notice of Allowance, Application No. 2020019535539, 3 pages, dated Mar. 16, 2020.
(Continued)

*Primary Examiner* — Joseph J Dallo
(74) *Attorney, Agent, or Firm* — Slayden Grubert Beard PLLC

(57) ABSTRACT

Various embodiments may include a method for operating a diesel-common-rail piezo-operated servo injector comprising: partially charging the piezo-actuator from a non-charged state at 0 V (method a); partially discharging the piezo-actuator from an already charged state to a remaining limited charge (method b); measuring the piezo-voltage with both methods and comparing the results; when the comparison demonstrates correspondence within a predefined threshold, using method b in ranges in which method a cannot be carried out; and when the comparison does not demonstrate correspondence within the predefined threshold, using method a without using method b.

7 Claims, 2 Drawing Sheets

(51) Int. Cl.
*F02D 41/38* (2006.01)
*F02M 57/00* (2006.01)
*F02M 51/06* (2006.01)
*F02M 63/02* (2006.01)

(52) U.S. Cl.
CPC ..... *F02M 51/0603* (2013.01); *F02M 57/005* (2013.01); *F02M 63/023* (2013.01); *F02D 2041/2051* (2013.01); *F02D 2041/389* (2013.01); *F02M 2200/21* (2013.01)

(58) Field of Classification Search
CPC ..... F02D 2041/2051; F02M 63/023; F02M 51/0603; F02M 57/005; F02M 2200/21
See application file for complete search history.

(56) References Cited

U.S. PATENT DOCUMENTS 8,051,839 B2 11/2011 Spadafora et al. ..... 123/498
8,590,513 B2 11/2013 Kondo et al. ..... 123/494
8,827,175 B2 9/2014 Fritsch et al. ..... 239/5
9,086,028 B2 7/2015 Schwarte et al.
9,766,290 B2 9/2017 Rodriguez-Amaya et al.
10,253,712 B2 4/2019 Zhang
2002/0008440 A1* 1/2002 Hedenetz ..... F02D 41/2096 310/316.03
2002/0117149 A1* 8/2002 Igashira ..... F02D 41/008 123/446
2003/0150429 A1* 8/2003 Rueger ..... F02D 41/2096 123/490
2004/0057189 A1* 3/2004 Cheever, Jr. ..... F02D 41/2096 361/160
2005/0231170 A1* 10/2005 Augesky ..... F02D 41/2096 320/166
2006/0082252 A1 4/2006 Allmendinger et al. ..... 310/316.03
2006/0152879 A1* 7/2006 Rueger ..... F02D 41/1489 361/160
2007/0103033 A1* 5/2007 Martin ..... F02D 41/2096 310/317
2007/0157905 A1* 7/2007 Augesky ..... F02D 41/2096 123/478
2009/0121724 A1* 5/2009 Perryman ..... F02D 41/2096 324/522
2009/0314073 A1* 12/2009 Perryman ..... F02D 41/2096 73/114.45
2014/0117882 A1* 5/2014 Viele ..... F02D 41/20 318/4
2014/0118877 A1* 5/2014 Viele ..... H02H 9/005 361/111
2014/0121846 A1* 5/2014 Dase ..... F02D 41/20 700/283
2014/0121939 A1* 5/2014 Viele ..... F02D 41/20 701/102
2014/0121945 A1* 5/2014 Viele ..... F02D 41/20 701/103
2014/0121946 A1* 5/2014 Viele ..... F02D 41/20 701/103
2015/0013647 A1 1/2015 Zhang et al. ..... 123/478
2015/0048718 A1* 2/2015 Etzler ..... F02D 41/2096 310/318
2017/0074197 A1 3/2017 Radeczky et al. ..... 123/478
2019/0128201 A1 5/2019 Dian et al.

FOREIGN PATENT DOCUMENTS

DE 102005046933 A1 4/2007 ..... F02D 41/20
DE 102006003861 A1 8/2007 ..... F02D 41/20
DE 102010022910 A1 12/2011 ..... F02D 41/20
DE 102010063681 A1 5/2012 ..... F02D 41/20
DE 102012204272 A1 9/2013 ..... F02D 41/20
DE 102013223764 B3 2/2015 ..... F02D 41/20
EP 2662555 A1 11/2013 ..... F02D 41/22
JP 10288119 A 10/1998 ..... F02D 41/20
JP 2001355538 A 12/2001 ..... F02D 41/04
JP 2005325838 A 11/2005 ..... F02D 41/20
JP 2009222051 A 10/2009 ..... F02M 45/00
JP 2010275987 A 12/2010 ..... F02D 41/40
WO 2017/182195 A1 10/1917 ..... F02D 41/20
WO 2015/176845 A1 11/2015 ..... F02D 41/20

OTHER PUBLICATIONS

German Office Action, Application No. 102016206476.2, 5 pages, dated Dec. 9, 2016.
International Search Report and Written Opinion, Application No. PCT/EP2017/055603, 21 pages, dated Apr. 20, 2017.
Korean Office Action, Application No. 20187029762, 5 pages, dated Dec. 4, 2019.
Chinese Office Action, Application No. 201780024457.8, 16 pages, dated Mar. 26, 2020.

* cited by examiner

DIESEL COMMON-RAIL PIEZO-OPERATED SERVO INJECTOR

CROSS-REFERENCE TO RELATED APPLICATIONS

This application is a U.S. National Stage Application of International Application No. PCT/EP2017/055603 filed Mar. 9, 2017, which designates the United States of America, and claims priority to DE Application No. 10 2016 206 476.2 filed Apr. 18, 2016, the contents of which are hereby incorporated by reference in their entirety.

TECHNICAL FIELD

The present disclosure relates to fuel injectors. Various embodiments may include a method for operating a diesel-common-rail piezo-operated servo injector in which a piezo-actuator opens and closes a nozzle needle by means of a servo valve.

BACKGROUND

A standard diesel-common-rail injector has an actuator which actuates a needle directly or indirectly (with a servo drive). A piezo-element can also be used as a sensor in order to detect characteristic events, such as for example the closing of the needle. This information can be used to improve the accuracy of the injection processes when controlling the injector.

In the case of a piezo-operated servo injector, the piezo-actuator opens a servo valve by means of the reverse piezo-electric effect, which in turn brings about opening of the nozzle needle by means of the hydraulic connection provided, as a result of which fuel is injected. If the piezo-element is not used as an actuator, it is possible to use it as a force sensor by means of the piezo-electric effect. Specifically, in this context the force which originates from the fuel pressure in the fuel chamber, which is arranged underneath the servo valve, said force acting on the servo valve, can be detected by the piezo-actuator if the piezo-actuator is in contact with the servo valve.

However, in the case of a piezo-servo injector with an air gap (in a non-charged state the piezo-actuator is not in contact with the servo valve here) the piezo-actuator must be charged to a certain extent to make contact with the servo valve. On the other hand, the quantity of charge which is applied to the piezo-actuator must not exceed a certain amount since this could bring about opening of the servo valve and therefore a measurement which changes the needle movement in the injector and therefore the quantity of the injected fuel.

SUMMARY

For the function of the piezo-actuator as a force sensor it is therefore of essential significance to find out the correct quantity of charge of the piezo-actuator for each operating point to bring about this force contact which is required for the force measurement, without at the same time actively influencing the injection itself by opening the servo valve. The teachings of the present disclosure may be embodied in a method with which the correct quantity of charge to be applied to the piezo-actuator to bring about a force contact thereof with the servo valve can be determined in a particularly accurate way.

As an example, some embodiments may include a method comprising:

determining the correct quantity of charge for the piezo-actuator for each operating point so that the latter brings about the force contact, necessary for the force measurement, with the servo valve without influencing the injection process itself by opening the servo valve, by partially charging the piezo-actuator from a non-charged state at 0 V (method a);

partially discharging the piezo-actuator from an already charged state to a remaining limited charge (method b);

measuring the piezo-voltage with both methods and comparing the results;

when there is sufficient correspondence, carrying out method b in ranges in which method a cannot be carried out; and when there is not sufficient correspondence, no application of method b.

In some embodiments, during a specific injection process, switching to and fro between method a and method b is carried out periodically for one engine cycle.

In some embodiments, the method is executed during a specific main injection during which the force measurement is carried out.

In some embodiments, said method is carried out at times at which no large change of the operating point takes place.

In some embodiments, the partial discharging of the piezo-actuator (method b) is carried out starting from the charged state of said piezo-actuator which is associated with an actual injection.

In some embodiments, the partial charging (method a) is executed after complete discharging of the piezo-actuator.

As another example, some embodiments include a motor vehicle having a diesel-common-rail piezo-operated servo injector and a control unit which is designed to carry out a method as described above.

BRIEF DESCRIPTION OF THE DRAWINGS

The teachings of the present disclosure are explained in detail below with reference to an exemplary embodiment in connection with the drawing. In the drawings.

DETAILED DESCRIPTION

Figure 1:
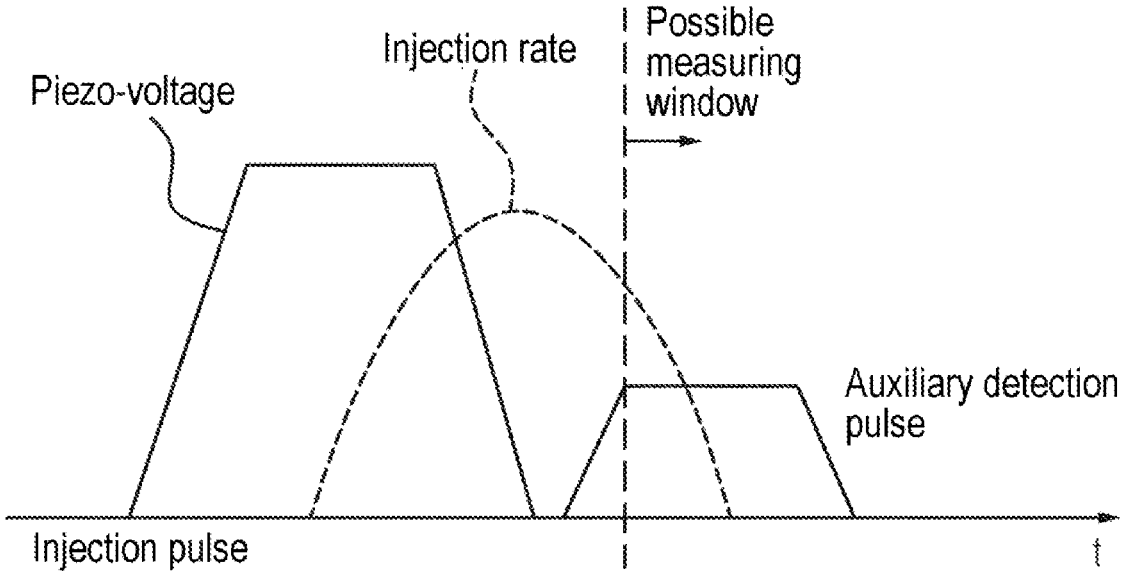
FIG. 1 shows a diagram which illustrates an example method incorporating teachings of the present disclosure.

Various methods incorporating teachings of the present disclosure may extend the sensor operating range of a piezo-actuator in a diesel-common-rail piezo-operated servo injector. With the two method variants a and b described above, a partially charged state of the piezo-actuator is achieved. The method a has the advantage that the range of the partial charging in which the piezo-actuator can be used as a sensor is larger than with method b, since in the case of method a the servo valve is already closed when the partial charge takes place and therefore a larger force can be applied to the servo valve than in the case of method b in which method the force acting on the servo valve has to be reduced, specifically to a value which is low enough for the servo valve to be able to close and for the injection event to end.

For this reason, it is easier to determine a suitable partially charged state by using the piezo-actuator according to method a.

The advantage of method b is that in the case of measurements in conjunction with an actual injection the time window in which the piezo-actuator can be used as a sensor is larger than in the case of method a. This is because in the case of method a the piezo-actuator firstly has to be completely discharged and then charged again. This actual lag time for the measurement does not occur in method b.

In operating ranges in which both method a and method b can be used, in the prior art method a is used, since this is the more robust method. However, in the methods described herein, both method variants are now carried out, and the piezo-voltage at the piezo-actuator is measured with both methods, and the results are compared with one another. If the correspondence between the two methods is large enough (specific voltage in the signal), it is assumed that a suitable correct charge level of the piezo-actuator can also be achieved with method b, so that the latter can be used as a sensor. When there is sufficient correspondence, method b is used in operating ranges in which method a cannot be carried out (as a result of timing restrictions). If, on the other hand, the correspondence between the two methods is not good enough, method b is not applied in ranges in which method a cannot be used.

As a result of the combined application of method b with the very robust method a it is possible to increase the robustness of method b and apply this method in a reliable way. It is therefore possible to increase significantly the operating range in which the piezo-element can be used as a sensor by virtue of the fact that the time range of the detection window is increased. In this way, in particular relatively small injected quantities of fuel can be detected.

In some embodiments, during a specific injection process, switching to and fro between method a and method b may be carried out periodically for one engine cycle, and specifically during the injection process in which the measurement is carried out. This involves, in particular, a specific main injection during which the force measurement is carried out. The method may be executed during such a main injection. In some embodiments, the method is carried out at times at which no large change of the operating point takes place, e.g. a stable rail fuel pressure and a comparable requested injection quantity are present.

In some embodiments, the partial discharging of the piezo-actuator (method b) is carried out starting from the charged state of said piezo-actuator which is associated with an actual injection. The partial charging (method a) may be executed after complete discharging of the piezo-actuator.

In some embodiments, there is a motor vehicle which has a diesel-common-rail piezo-operated servo injector of the type described above and a control unit designed to carry out the method described above.

In some embodiments, the piezo-actuator is actuated as a sensor to measure the force applied to the servo valve. To carry out the corresponding force measurement, the correct quantity of charge for the piezo-actuator may be determined so that said piezo-actuator brings about the force contact, necessary for the force measurement, with the servo valve without influencing the injection process itself by opening the servo valve. In other words, the piezo-actuator has to overcome the air gap, present in the non-charged state, between the actuator and the servo valve.

For this purpose, according to the method a illustrated in FIG. 1, the piezo-actuator is partially charged from a non-charged state at 0 V. In FIG. 1, the corresponding piezo-voltage is illustrated as a function of the time, wherein an injection pulse of a main injection and a subsequent auxiliary detection pulse for partial charging are illustrated. The possible measuring window for carrying out the method a is shown to the right of the dashed line.

Figure 2:
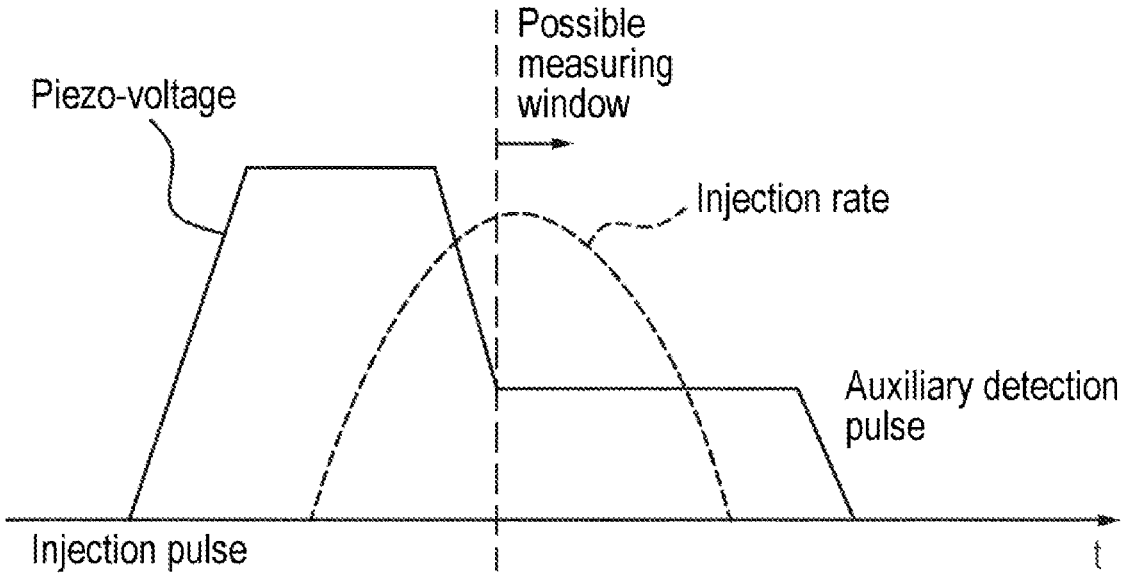
FIG. 2 shows a diagram which illustrates an example method incorporating teachings of the present disclosure.

In the method b illustrated in FIG. 2, partial discharging of the piezo-actuator from an already charged state (injection pulse) to a remaining charge takes place. Here, the injection pulse and the auxiliary detection pulse according to method variant b are also illustrated. It is apparent that the possible measuring window indicated to the right of the dashed line is larger here than in the case of method a.

Figure 3:
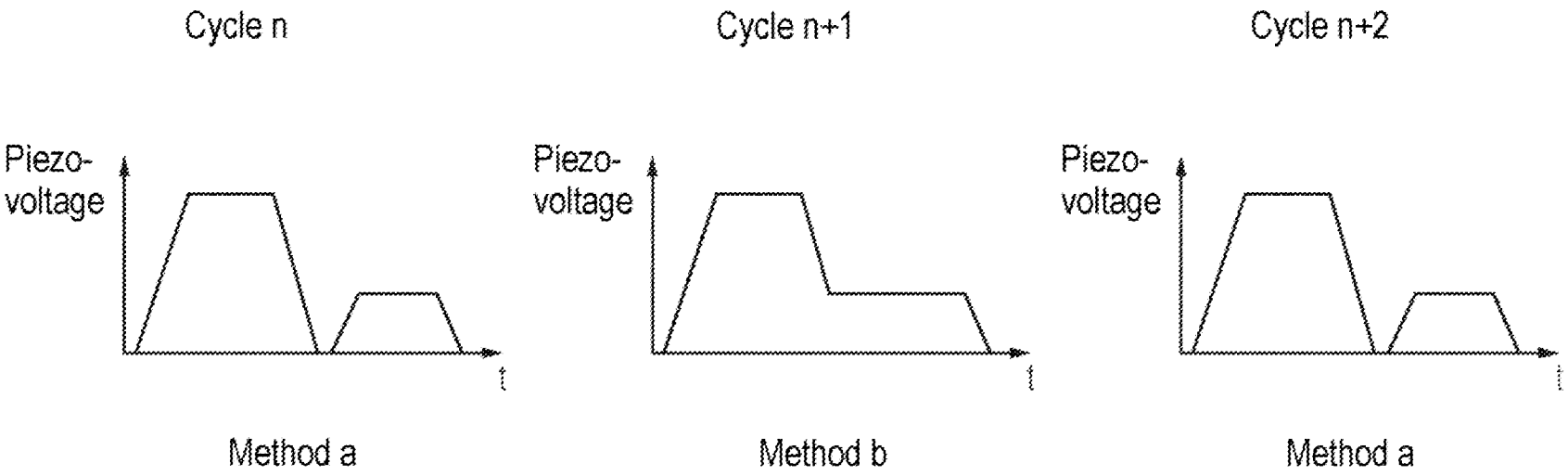
FIG. 3 shows a diagram which shows the sequence of an example method incorporating teachings of the present disclosure in three illustrations.

FIG. 3 shows the execution of an example method incorporating teachings of the present disclosure in which, during a specific injection process, switching to and fro between method a and method b is carried out periodically for one engine cycle. In the left-hand diagram, method a is illustrated for cycle n, in the middle diagram method b is illustrated for cycle n+1, and in the right-hand diagram method a is illustrated again for cycle n+2. In the diagrams, an injection pulse and an auxiliary detection pulse are also illustrated in each case for the corresponding method.

The piezo-voltage at the piezo-actuator is measured with both methods, and the results are compared with one another. When there is sufficient correspondence, method b is carried out in ranges in which method a cannot be carried out. When there is not sufficient correspondence no application of method b takes place.

What is claimed is:

1. A method for operating a diesel-common-rail piezo-operated servo injector in which a piezo-actuator opens and closes a nozzle needle by means of a servo valve, the method comprising:

partially charging the piezo-actuator from a non-charged state at 0 V (method a);

partially discharging the piezo-actuator from an already charged state to a remaining limited charge (method b);

measuring the piezo-voltage with both methods and comparing the results;

determining a voltage for the piezo-actuator for each operating point so that the piezo-actuator applies a force necessary for contact with the servo valve without influencing the injection process itself by opening the servo valve;

when the comparison demonstrates correspondence within a predefined threshold, using method b in ranges in which method a cannot be carried out; and when the comparison does not demonstrate correspondence within the predefined threshold, using method a without using method b.

2. The method as claimed in claim 1, further comprising switching to and fro between method a and method b during a specific injection process throughout one engine cycle.

3. The method as claimed in claim 1, further comprising measuring the force during a specific main injection.

4. The method as claimed in claim 1, further comprising measuring the force during times at which no large change of the operating point takes place.

5. The method as claimed in claim 1, further comprising carrying out the partial discharging of the piezo-actuator (method b) starting from a charged state of said piezo-actuator associated with an actual injection.

6. The method as claimed in claim 1, further comprising executing the partial charging (method a) after complete discharging of the piezo-actuator.

7. A motor vehicle comprising:

a combustion chamber;

a diesel-common-rail piezo-operated servo injector operating to inject fuel into the combustion chamber; and a control unit programmed to:

partially charge the piezo-actuator from a non-charged state at 0 V (method a);

partially discharge the piezo-actuator from an already charged state to a remaining limited charge (method b);

measure the piezo-voltage with both methods and comparing the results;

determine a voltage for the piezo-actuator for each operating point so that the piezo-actuator applies a force necessary for contact with the servo valve without influencing the injection process itself by opening the servo valve;

when the comparison demonstrates correspondence within a predefined threshold, use method b in ranges in which method a cannot be carried out; and when the comparison does not demonstrate correspondence within the predefined threshold, use method a without using method b.

* * * * *